United States Patent [19]

Kopsch et al.

[11] 4,434,718

[45] Mar. 6, 1984

[54] SABOT AND PROJECTILE

[76] Inventors: Paul J. Kopsch, 710 Cooper Foster Park Rd., Lorain, Ohio 44053; Donald F. Ward, 48264 Telegraph Rd., South Amherst, Ohio 44001; Jay Graber, 7370 Amity Pike, Plain City, Ohio 43064; Omer Nichols, R.D. 8, Box 175, Greensburg, Pa. 15651

[21] Appl. No.: 301,444

[22] Filed: Sep. 11, 1981

[51] Int. Cl.[3] ..... F42B 13/16

[52] U.S. Cl. ..... 102/522; 102/439; 102/501

[58] Field of Search ..... 102/430, 439, 501, 520–523, 102/532, 703; 244/244.23, 244.24

[56] References Cited

U.S. PATENT DOCUMENTS

| | | | |
|---|---|---|---|
| 3,099,958 | 8/1963 | Daubenspeck et al. | 102/449 |
| 3,392,934 | 7/1968 | Daniels | 244/3.23 |
| 3,545,383 | 12/1970 | Lucy | 102/703 X |
| 3,599,568 | 8/1971 | Shellnutt | 102/703 X |
| 3,721,194 | 3/1973 | Weston, Jr. | 102/449 |
| 4,083,306 | 4/1978 | Woodring | 102/520 X |
| 4,220,090 | 9/1980 | Fackler | 102/449 |

FOREIGN PATENT DOCUMENTS

| | | | |
|---|---|---|---|
| 1262830 | 3/1968 | Fed. Rep. of Germany | 102/520 |
| 2335818 | 7/1977 | France | 102/520 |
| 645353 | 9/1962 | Italy | 102/449 |

*Primary Examiner*—Harold J. Tudor
*Assistant Examiner*—Tyrone Davis
*Attorney, Agent, or Firm*—Gustalo Nunez

[57] ABSTRACT

A discarding sabot projectile for shotgun of unique construction whereby the separation of the projectile and sabot is enhanced by opposing air pressure and the unique construction of the sabot. The sabot as utilized herein comprises a plastic body firmly encompassing, but not completely encapsulating a subcaliber projectile. The plastic body includes a plurality of longitudinally extending slots forming symmetrical segments and further, segment having longitudinally extending grooves for reducing friction between the barrel bore and the sabot. The segments are further defined at the other end thereof by longitudinal tapered edges. The sabot, upon exiting the launching device begins to separate from the enclosed projectile beginning at the uppermost front end of the sabot as a result of air pressure flowing in the opposite direction of the sabot. The longitudinal segment radially separates and will spread outwardly and as a result, the segments act as an air brake reducing the forward speed of the speed of the sabot. This results in the separation of the sabot and projectile. The separation is such that it does not interfere with the trajectory and the velocity of the subcaliber projectile, hence, resulting in a longer and more accurate trajectory.

2 Claims, 7 Drawing Figures

SABOT AND PROJECTILE

BACKGROUND OF THE INVENTION

1. Field of the Invention

This invention relates to a sabot for use with a subcaliber projectile, and more particularly, to sabots which can be used with a shotgun, with the shotgun cartridge utilized as the carrier for the sabot, projectile and propellant.

2. Description of the Prior Art

Because of the increasing technology with respect to metals, and particularly with respect to the strength imparted to metals, it is necessary to develope prdjectiles having high velocity and accuracy in order to penetrate these strengthened metals as used in present day tanks, armored vehicles and tanks. Also, more particularly, it is desirable to make weapons more versatile, e.g. utilizing a shotgun for the firing of a single projectile rather than pellets. This converts a shotgun into a longer-range weapon. With presently-marketed single projectiles, one can hit up to approximately 100 yards. With our stable and rotating projectile, one can hit at over 200 yards. Thus, the effective distance of the most common smooth-bore weapon is more than doubled by our invention.

Sabots in the past have generally been used for the purpose of adapting small caliber projectiles for firing from a larger caliber bore which effectively converts the weapon for different uses.

Ideally, it is desired to have the sabot separate from the projectile immediately upon exiting the launching tube, e.g. a rifled or smooth bore barrel, without effecting the velocity and trajectory of the projectile. Many of the prior art sabots have accomplished this to some degree. The prior art sabots relied primarily upon centrifugal forces and generated gas pressures to effect the separation of the sabot from the projectile. They also required a combination of complicated parts to make up the sabot. It can be understood that these conditions impose limitations on the efficiency of the sabot by effecting the accuracy of the projectile, by unduly restricting the type of weapon which could be used, and by creating unnecessarily high expenses to produce.

Anspacher, et al, in U.S. Pat. No. 2,998,780 discloses a sabot for a fin stabilized projectile which experiences separation upon exiting the barrel. However, closer inspection reveals that the combination of sabot and projectile is so mechanically complex that its reliability would be suspect. The greater portion of the weight of the projectile is found in the base which could cause flight instability. The fins used on the projectile are parallel with respect to the longitudinal axis of the projectile and the depth of the fins are perpendicular to the longitudinal axis which quite different from the combination contemplated by the petitioners herein. The structure utilized by Anspacher is inherently complex and expensive to fabricate. Anspacher requires a shearing action to release, which can be and usually is undependable. A principal featureof petitioners' design is a launching fin stabilized projectile from a shotgun. A projectile such as this does not require barrel riflings or the like for causing the projectile to spin.

Turning now to Manning, et al, U.S. Pat. No. 3,427,648, which teaches a sabot and finned projectile, it can be seen that the combination is a very complicated and complex structure. In normal launching of a projectile, the forward velocity increases after exiting the barrel until the gas pressure no longer acts reacts on the base of the projectile. In order to impart spin to the projectile, Manning utilizes a sabot having segments adapted to fit in the rifling grooves of the barrel such that when the weapon is fired, the sabot segments cause the projectile to follow the twist of the rifling thus inducing a stabilizing spin to the projectile. Quite unlike the petitioners' invention, Manning uses the muzzle of the gun bore for effecting the separation of the sabot and projectile. In Manning, grooves in the gun tube (barrel) are deepened causing the speed of the sabot to be retarded while in the barrel, thus permitting the projectile to exit the barrel first. One objection to this is the fact that some of the retardation would, by the inherent construction of the invention, be applied to the projectile. This would result in a less than optimum speed for the projectile, thus reducing the velocity of the projectile and denigrating the primary purpose of the sabot.

Feldman in U.S. Pat. No. 3,847,082 also discloses a spin stabilized discarding sabot projectile. Feldman also teaches a complex solution to a complex problem in that the projectile is completely encapsulated by the sabot. As a result, he must effect the separation of the projectile and sabot quite contrary to that taught by the prior art. Certain portions of the sabot rupture while being accelerated in the barrel and as the sabot clears the muzzle exit, utilizes the high pressure gases exiting the muzzle to push and disintegrate the sabot and therefore cause the separation of the sabot from the projectile. It can be seen that this type of sabot would impart its drag to the projectile. Discard of the sabot requires the segments to increase in velocity over the velocity of the subprojectile.

Björnson, U.S. Pat. No. 4,029,018 solves the problem of sabot and projectile separation very simply. He utilizes a sabot with slotted segments at one end and unslotted portion at the other end. The unslotted portion acting as an obturator for directing the high velocity gases onto itself and the projectile. Once out of the muzzle bore, centrifugal and air forces acting on the slotted segments cause the slotted segments to disintegrate thus causing separation of the sabot and projectile. However, the sabot which is designed with internal screws is screwed on to the projectile for a supposedly tighter connection. This type of intimate connection results in any drag applied to the sabot also applied to the projectile prior to separation. There is no such connection between the sabot and projectile as contemplated by the applicant herein. Further, Björnson does not take into account a stabilized projectile. The only concern shown is for the separation. In Björnson, the sabot "pulls" the subprojectile during launch.

The present-day smooth bore weapon of common usage is the shotgun. Of various bore diameters and mechanical types, it has evolved from the heavy matchlock musket over the last 350 years. One can fire a cluster of small shot from it and reasonably hope to bring down a bird on the wing at 40 yards. One can fire a slug and reasonably hope to bring down a man or a deer at 100 yards. These figures have not essentially changed over the centuries. It is believed that the maximum range for single-projectile loads can reasonably be doubled at the present time.

Biology teaches us that ontogeny recapitulates phylogeny, so it should not be a matter of surprise that our thoughts here are of increasing the lethal range of fire-arms. In man's 5000 years of recorded history there have been about 210 years of peace. And one of his most ancient dreams has been of a weapon so powerful that all he had to do was point his finger at his adversary and blow him away.

About 1540 the Duke of Alva introduced a large heavy smooth bore matchlock into the Spanish army. It fired round lead balls, 10 to the pound, and under the name of "musket" (from the Italian "moschetto", male sparrow-hawk) came into general use throughout Europe. Ignition systems were improved over the centuries by wheelock, flintlock, percussion, and self-contained cartridge. Military small arms started evolving to their present small bore rifled configuration in the mid-nineteenth century. Smooth bore small arms have gradually evolved to the present day shotgun.

Over the centuries, the projectiles used with the smooth bore small arm have remained much the same—either a cluster of small circular shot, or one large slug which fits the bore quite snugly. A notable recent advance was the flechette (lit., little arrow), a small finned all-steel dart. These were fired individually in the "special purpose individual weapon" of the U.S. Army, and in clusters numbering into the thousands in the 105 millimeter cannon. Their penetration is however poor, being somewhat less than #5 shot (lead pellets 0.12 inch diameter). Hits and kills with any of these at ranges greater than 100 yards are problematical.

Large caliber smooth bore weapons appear in such things as tank cannons, mortars, rocket launchers, and torpedo tubes. Several of these devices depend on in-flight guidance and/or proximity fuses to secure satisfactory accuracy and maximum lethality. The scale and expense involved with these large caliber smooth bore devices make them prohibitive for the private experimenter.

Thus, unless one is prepared to work out a whole new weapons system, it is best to work with one whose limitation of range and accuracy are quite well defined: the 12 gauge shotgun. Previous attempts at loads affective at long range well known to those skilled in the art include British, French, German and American designs. All of these save the American BRI are borefitting nonrotating short fat slugs. The BRI is a discarding sabot round, 0.5 inch diameter, with what amounts to a 3 piece sabot. It has not lived up to its initial optimistic claims due to misaligned sabots and an unfavorable length/diameter ratio of the projectile itself.

Let us consider the sabot round. In a discarding sabot round, the projectile is held in a carrier and both are fired out of the cartridge case together. The carrier is made of lighter material than the projectile. Shortly after leaving the muzzle, the carrier detaches and falls away; the projectile speeds on to the target by itself. The combined weight of carrier plus small-diameter projectile is less than the weight of a bore-fitting projectile. The same amount of propellent can thus be burned under a lighter payload. In large caliber artillery pieces this has yielded markededly increased velocity and range for armor-piercing rounds. An additional benefit is that erosion of the bore by hot gases is decreased, since the gun-tube area used to attain the velocity of the projectile is greatly increased. Muzzle velocity is increased, kinetic energy of the projectile is enhanced with no change in recoil vis a vis the conventional bore-fitting projectile. Kinetic energy goes up as the square of the velocity—$\frac{1}{2}MV^2$—while the recoil remains at mv. Thus if attained breech pressures were to allow an oversimplified solution one could halve the projectile weight and double the velocity with no change in recoil but a doubling of the kinetic energy of the projectile.

The projectile and sabot must be of a structure such that the cooperation of the two individual structures enhance separation and accuracy. The shooting of a unitary projectile, ball or bullet through a barrel has a long history and a great deal of activity as evidenced by the large number of patents directed to sabots. The research, interest and activity has been directed to increasing the accuracy of the projectile as well as the kill power. In the 1860's the best that one could expect, if the ball fit the bore reasonably well, was that a man size target could be hit most of the time. Prior to this, in 1615 when the musket was introduced, the accuracy was considerably less. The applicants have solved the age old problem of effectively firing a projectile and sabot with an increase in efficiency, accuracy and velocity. Simply and elegantly by using a projectile, heavy in the forward end having fins for stabilizing and providing spin on the aft end. The fins have a 30° to 40° slope for lessening air resistance. The combination of a projectile with maximum diameter fins and eccentric placement on the projectile in combination with a sabot of simple construction provide a very efficient weapon system with results not accomplished in the prior art cited above.

SUMMARY OF THE INVENTION

The limitations discussed in the prior art are overcome by the present invention, which utilizes one unitized structure for the sabot body. The sabot, as taught by the applicant, comprises a body having a plurality of longitudinally extending slots defining a plurality of symmetrical segments terminating at one end to a base and the other end terminating in an end having a tapered configuration on both sides, each of the segments having inscribed thereon, longitudinal grooves for decreasing friction between the sabot and bore. The applicants herein have solved the centuries old problem of firing a projectile through a bore with increased accuracy and velocity. The structure as contemplated is very simple and inexpensive to manufacture. It consists of a unitized sabot and a projectile for insertion in said sabot.

The projectile is unique in that the shape has taken into account the length over diameter such that there is approximately a 5 to 1 ratio. Further, 50% of the projectile weight is positioned in the forward third of the projectile. The projectile has four (4) fins affixed at the aft portion thereof. These fins are eccentric with respect to the longitudinal axis of the projectile. Further, the fins have a foward slope of 30° to 45° for optimum stability and minimum air resistance. Sabot refers to a sleeve type of container into which is placed a projectile prior to being fired out of a firearm having a barrel. The sabot may be a simple sleeve open at both ends, or closed at one end and open at the other, or completely closed at both ends with the projectile contained inside. The sabot is used in firing projectiles from gun barrels which have a bore diameter larger than the projectile diameter. The sabot is used for transmitting the accelerating force to the projectile as it travels through the barrel bore. In any event, once the combination of sabot and projectile exit the barrel bore, the combination must be severed. This may be accomplished in many ways, e.g., the utilization of air force to separate the sabot and projectile; the combination of generated high pressure gases and air resistance to cause the disintegration of the sabot thus allowing the projectile to continue on to its target. How the separation is accomplished is very very critical in that it must be done immediately upon exit of the bore without affecting the speed of the projectile. The ideal sabot also permits the firing of the projectiles having difference ballistic shapes to be fired from the same weapon. This increases the versatility of the particular weapon.

The sabot contemplated by the applicants is of unitary plastic structure having a plurality of segments cut along lines defining by the longitudinal axis of the sabot sleeve. The particular segments at the forward ends are tapered to increase air resistance, and open out the petals as soon as possible after exiting the bore, thus ensuring prompt discard of the sabot. At the base of the sabot is placed a metal disc to eliminate the possibility of high pressure gases generated by the firing of the propellant perforating the plastic base portion of the sabot. and to eliminate the perforation of the sabot by the setback of the projectile at the moment of acceleration by the expanding propellant gases as the shell is fired. The outside surface of the radially extending segments are inscribed with grooves direct along lines parallel to the longitudinal axis of the sabot sleeve. These grooves reduce friction between the muzzle bore and the sabot as it is accelerating through the bore. Upon exiting the muzzle bore, the segments are opened immediately by air forces and thus "pushed" away from the projectile. Once in flight, the eccentrically positioned fins impart a stabilizing spin to the projectile.

BRIEF DESCRIPTION OF THE DRAWING

Further objectives and advantages of the invention will be hereafter referred to and be apparent from the following description of the preferred embodiment of the improved sabot and projectile, shown particularly in the accompanying drawings and set forth in the claims.

The description of the preferred embodiment when read in connection with the accompanying drawings wherein similar reference characters have been used to designate corresponding parts throughout.

DESCRIPTION OF THE PREFERRED EMBODIMENT

Figure 1:
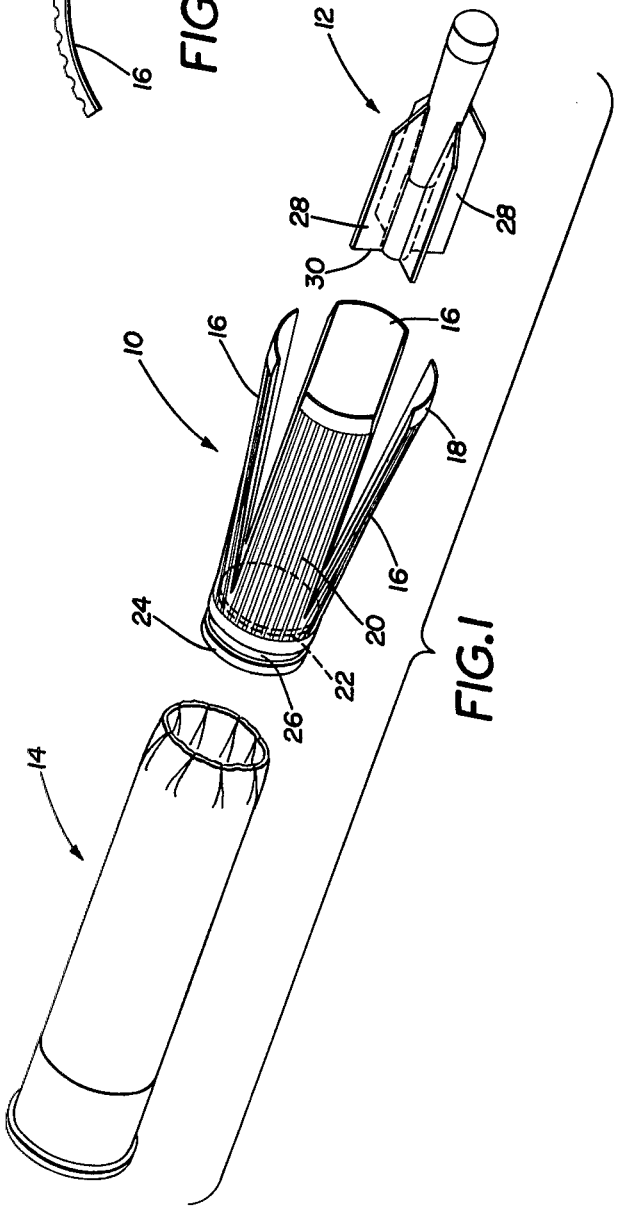
FIG. 1 is an exploded perspective view of the sabot, projectile and shotgun cartridge.

The improved sabot is indicated generally at 10 and the improved projectile is indicated generally at 12. There is shown in FIG. 1, a shot gun cartridge at 14 for the purpose of indicating what form of propellant may be used to impart an accelerating force to the sabot. Of course other means may be utilized, and it is indicated here that the propelling force is not a part of this invention.

The improved sabot 10 comprises a plurality of radially extending segments 16 cut in the direction of the longitudinal axis of the sabot 10. The segments 10 are tapered at the foremost end 18. This taper at 18 increases air friction once the sabot and projectile are air born for reasons which will soon be obvious. Found on the outside surface areas of the radial segments 16 are a plurality of longitudinally extending grooves 20. These grooves 20 reduce friction between the sabot 10 and the inside surface of the muzzle bore as the sabot 10 is being propelled through the bore, (not shown).

At the aft end of the sabot 10, inside the sleeve is a metallic disc 22 preferably made of high quality aircraft aluminum, known for its lightness and strength. The purpose of disc 22 will be hereinafter explained. Also, at the aft end of the sabot 10 is a base 24 which is a plastic base somewhat thicker than the segments 16. The base must be thicker for it is this portion of the sabot which must accept the thrust of the propelling forces generated by the exploding propellant. The base 24 in combination with the disc 22 prevents the pressurized gases from perforating the aft end of the sabot and also prevents perforation of the sabot by projectile setback. If this condition were not prevented, the gases could rush right through the sabot and out the muzzle bore by flowing past the projectile 12. This condition would result in an inaccurate and highly inefficient projectile.

The base 24 also includes a radial groove 26 which is formed during the molding of the sabot. The radial grove 26 could be used to impart spin to the sabot 10, if desired, by simple design.

Figure 3:
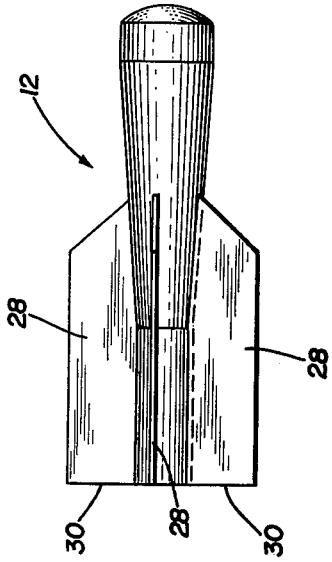
FIG. 3 is an enlarged plan view of the projectile.
Figure 2:
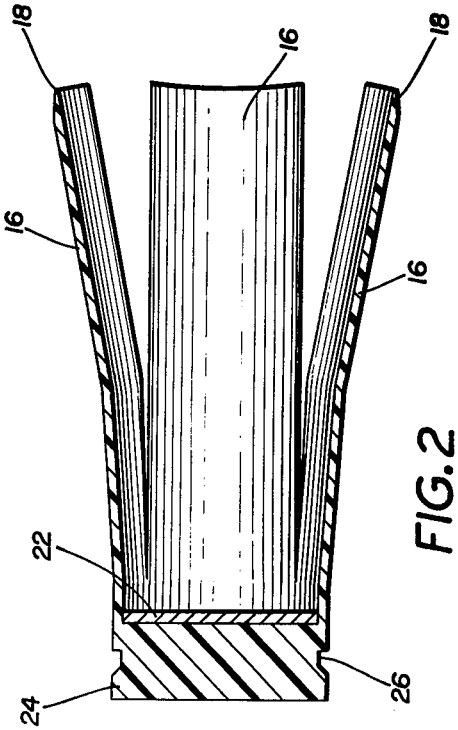
FIG. 2 is an enlarged longitudinal sectional view of the sabot sleeve.

The projectile 12 shown in FIG. 3, includes a plurality of fins 28 along the botton half of the projectile. The fins 28 are positioned eccentrically to the longitudinal axis of the projectile. The preferred embodiment shows four fins 28 at the forward end which are sloped at an angle of 30° to 45°. This slope reduces air friction and the eccentrical placement of the fins 28 impart stabilizing spin to an air born projectile. The projectile 12 is designed such that at least 50% of the projectile weight is concentrated in the forward third of the projectile 12. The combination of the length over diameter ratio, eccentrical placement of the fins 28, the forward slope of the fins 28 and the concentration of the forward weight provides a projectile having characteristics of a highly stabilized air born projectile thus inherently providing increased velocity and accuracy.

Figure 5:
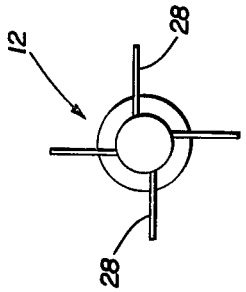
FIG. 5 is a rear elevational view of the projectile shown in FIG. 3.
Figure 4:
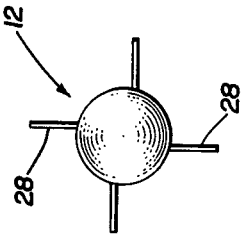
FIG. 4 is a front elevational view of the projectile shown in FIG. 3.
Figure 7:
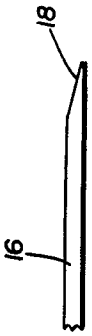
FIG. 7 is an enlarged side view of the foremost end of the segment illustrating the tapered end.
Figure 6:
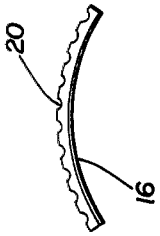
FIG. 6 is an enlarged end view of a portion of the radial segment illustrating the grooves.

FIGS. 5 and 6 are shown to disclose and emphasize the eccentrical placement of the fins 28 on the aft end of the projectile 12. In operation, the aft ends 30 of the fins 28 would rest on the base 22 of the sabot 10. A portion of the projectile 12 would extend beyond the taper ends 18 of the segments 16. The entire sabot 10 and projectile 12 would then be placed inside a conventional shotgun cartridge 14. The particular embodiment described herein could then be fired with a conventional shotgun, thus increasing its versatility. Upon firing, the projectile is propelled through the barrel, the base portion 24 being in intimate engagement with the inside surface of the barrel, thus preventing the forward escape of the highly pressurized gases generated by the exploding propellant found in the cartridge 14. Upon exiting the muzzle or barrel, air forces immediately cause the segments 16 to open. The segments 16 once partially open cause a drag effect on the sabot 10 which increases proportionally with the opening of the segments 16. The result being that the sabot 10 is left behind while the projectile 12 continues forward. Spin is imparted on the projectile immediately upon being air borne by the eccentrical positioning of the fins 28. The combination of the larger diameter fins 28 and their eccentric placement are what secure the rotation and stability of the flying projectile on its way to its target.

The projectile 12 can be manufactured from materials such as plastic, steel, copper, lead or the like, depending upon the intended use. As will be apparent to those skilled in the art to which this invention is directed, the above described invention should not be limited to the particular construction shown and described, but may be modified, it being the intention here to cover all adaptations, modifications and uses thereof which come within the practice of those skilled in the art to which this invention relates and should not be so limited but include those changes and modifications coming within the terms of the claims set forth below.

I claim:

1. A self-separating sabot for use in combination with a projectile for firing through a shotgun bore, comprising:

(a) An elongated cylindrical sabot body having a base portion at the aft end thereof and a plurality of longitudinally extending segments open at the forward end thereof, said sabot body having a metallic disc positioned on the inside surface of said base defined by the closed end of said segments, and wherein said base portion is thicker than said longitudinally extending segments, and wherein said longitudinally extending segments have inscribed thereon, a plurality of longitudinally extending grooves for reducing friction between said sabot and said shotgun bore: and (b) a projectile adapted for insertion in said sabot body, said projectile having a plurality of eccentrically placed fins at the aft end thereof, said fins being supported by said metallic disc, said projectile being further defined in that the greater portion of its weight is positioned in the forward third of said projectile; and (c) means for propelling said sabot body and projectile through and out said barrel; and (d) said longitudinally segmented ends being responsive to air forces such that said segments open in a radially outwardly direction thereby separating from said projectile.

2. A self-separating sabot for use in combination with a projectile for firing through a shotgun muzzle, comprising:

(a) an elongated cylindrical sabot body having a base portion at the aft end therof and a plurality of longitudinally extending segments open at the forward end thereof said segments having a plurality of longitudinally extending grooves inscribed on an outside surface of said segments, and further, said segments being tapered at the forward ends, said taper being in a longitudinal direction in a forward to aft direction, said sabot body having a metallic disc positioned on the inside surface of said base portion defined by the closed end of said segments, and said base portion being thicker than said segments; and (b) a longitudinal circular projectile adapted for insertion in said sabot body, said projectile having a plurality of eccentrically placed fins formed integral thereto at the aft end thereof, said eccentrical fins being supported by said metallic disc, said projectile being further defined in that the greater portion of its weight is positioned in the forward third of said projectile, and said length of said projectile having a length over diameter ratio equal to at least 5:

(c) means for propelling said sabot body and projectile through and out said shotgun muzzle; and (d) said longitudinally tapered segmented ends being responsive to air forces such that said segments open in a radially outwardly direction thereby separating from said projectile.

* * * * *